US012343656B1

(12) United States Patent
Zou

(10) Patent No.: US 12,343,656 B1
(45) Date of Patent: Jul. 1, 2025

(54) 3D MODEL-PRESSING SHOE SOLE

(71) Applicant: Chunliang Zou, Guangzhou (CN)

(72) Inventor: Chunliang Zou, Guangzhou (CN)

( * ) Notice: Subject to any disclaimer, the term of this patent is extended or adjusted under 35 U.S.C. 154(b) by 0 days.

(21) Appl. No.: 18/910,765

(22) Filed: Oct. 9, 2024

(51) Int. Cl.

| | |
|---|---|
| ***A63H 33/32*** | (2006.01) |
| ***A43B 3/00*** | (2022.01) |
| ***A43B 13/04*** | (2006.01) |
| ***A43B 13/14*** | (2006.01) |

(52) U.S. Cl.
CPC ..... *A63H 33/32* (2013.01); *A43B 3/0036* (2013.01); *A43B 13/04* (2013.01); *A43B 13/14* (2013.01)

(58) Field of Classification Search
CPC ..... A63H 33/32; A43B 3/0036; A43B 13/04; A43B 13/14
USPC ..... 446/70; 472/126
See application file for complete search history.

(56) References Cited

U.S. PATENT DOCUMENTS

| | | | | |
|---|---|---|---|---|
| 3,538,628 | A | 11/1970 | Einstein, Jr. | |
| 4,958,446 | A | 9/1990 | Brown | |
| 5,331,753 | A | 7/1994 | Rodibaugh | |
| 5,586,501 | A * | 12/1996 | Burguera | A43B 1/0027 101/368 |
| 5,980,351 | A | 11/1999 | Mccook | |
| 6,080,033 | A * | 6/2000 | Fladwood | A43B 3/00 101/103 |
| 6,497,056 | B1 | 12/2002 | Mcgoveran | |
| 8,075,456 | B2 | 12/2011 | Fugitt | |
| D675,410 | S | 2/2013 | Day | |
| D734,007 | S | 7/2015 | Osiol | |
| 9,687,043 | B2 | 6/2017 | Kenney | |
| 2002/0166258 | A1 | 11/2002 | Posa | |
| 2005/0120589 | A1 | 6/2005 | Coomes | |
| 2005/0189084 | A1 * | 9/2005 | Bitton | A63H 33/32 164/109 |
| 2017/0150779 | A1 * | 6/2017 | Walker | A43B 3/34 |
| 2019/0000177 | A1 * | 1/2019 | Dervish | A43B 7/1425 |

OTHER PUBLICATIONS

U.S. Appl. No. 19/022,350—Non-Final Office Action mailed on Apr. 2, 2025, 7 pages.

* cited by examiner

*Primary Examiner* — Kien T Nguyen
(74) *Attorney, Agent, or Firm* — Getech Law LLC; Jun Ye

(57) ABSTRACT

This invention pertains to the field of toy technology and discloses a shoe sole that can press out 3D models, which includes a toy shoe sole main body made of PVC material. The characteristic of the invention are as follows: The upper surface of the said toy sole body is provided with a shoe treading surface, and the interior of the shoe treading surface is provided with a deflector slope and an ink inlet. The ink inlet is located in the center of the deflector slope. The interior of the toy sole body is provided with a color ink storage chamber, which enables the user to press 3D three-dimensional models of various shapes by simple foot movements when walking or playing in the snow, increasing the fun and interactivity of snow activities.

10 Claims, 6 Drawing Sheets

3D MODEL-PRESSING SHOE SOLE

FIELD OF TECHNOLOGY

This invention relates to the field of toy technology, more specifically to a 3D model-pressing shoe sole.

BACKGROUND

With the progress of society and the improvement of people's living standards, consumers' demands for winter outdoor activities have been increasing. They are no longer satisfied with basic warmth, anti-slip, and comfort but are beginning to pursue more entertainment and creativity to obtain a richer and more diverse experience in outdoor activities. Especially in family outings, friend gatherings, and other scenarios, a snow shoe product that can add interactive fun and stimulate creativity is particularly important. Against this backdrop, many innovative products that combine entertainment with snow shoes have emerged in the market, such as snow boots with light-emitting devices, skis with adjustable music playback, etc. These products have met users' new demands for outdoor activities to some extent, but they have not yet touched the level of direct interaction with the snow and the creation of personalized 3D models through the sole of the shoe.

Currently, there is no product on the market that can directly press and retain 3D models in the snow with the sole of the shoe. Such products not only require the sole material to have sufficient wear resistance, anti-slip, and shape recovery ability but also need to achieve a unique interaction between users and the snow through ingenious structural design. At the same time, considering the variability and uncertainty of outdoor activities, such products also need to meet high standards in terms of durability, ease of use, and safety. Therefore, this invention aims to fill this market gap by innovating the sole design to achieve the function of users freely creating 3D models in the snow, adding new fun and creativity to snow activities.

SUMMARY

To address the issues raised in the background technology, this invention provides a shoe sole capable of pressing out 3D models, which, when combined with traditional winter shoes, brings users an unprecedented interactive experience and creative fun.

To achieve the aforementioned purpose, this invention provides the following technical solution: a 3D model-pressing shoe sole, which includes a shoe sole toy main body made of PVC material. The characteristics are as follows: the upper surface of the toy shoe sole main body is equipped with a shoe treading surface. The interior of the shoe treading surface is provided with a deflector slope. The interior of the shoe treading surface is equipped with an ink inlet. The ink inlet is located at the center of the deflector slope. The interior of the toy shoe sole main body is equipped with a color ink storage chamber. The bottom surface of the toy shoe sole main body is equipped with a touch surface.

The interior of the touch surface is equipped with an animal 3D printing slot.

Preferably, the upper surface of the shoe treading surface is integrally molded with a set of friction beads, and the friction beads are arranged equidistantly on the upper surface of said shoe treading surface.

Preferably, the upper surface of said shoe treading surface is integrally molded with a backstop lug, and a set of first lacing holes are provided in the interior of said backstop lug.

Preferably, the upper surface of the shoe treading surface is integrally molded with two front vertical lugs, and both front vertical lugs are provided with a set of second lacing holes internally.

Preferably, a set of friction grooves are provided on the outer surface of the touch surface, and the friction grooves are provided equidistant from each other on the bottom surface of the touch surface.

Preferably, the said animal 3D stereo printing groove is a bear 3D stereo printing groove.

Preferably, two bear eye 3D printing slots are provided in the interior of the bear 3D printing slot. Bear eye connection through-holes are provided above both the bear eye 3D printing slots. The two bear eye connection through-holes are provided in the interior of the toy sole body and connected to the color ink storage chamber.

Preferably, the said animal 3D stereo printing slot is a penguin 3D stereo printing slot.

Preferably, two penguin eye 3D printing slots are provided in the interior of the penguin 3D printing slot. Penguin eye connecting through holes are provided above both the penguin eye 3D printing slots. The two penguin eye connection through-holes are provided in the interior of the toy sole body and are connected to the color ink storage chamber.

Preferably, the said animal 3D stereo printing slot is a piglet 3D stereo printing slot.

Preferably, two piglet eye 3D printing slots are provided in the interior of the piglet 3D printing slot. Piglet eye connecting holes are provided above both the piglet eye 3D printing slots. The two piggy eye connection through-holes are provided in the interior of the toy sole body and are connected to the color ink storage chamber.

Advantages of the Invention

1. The invention allows users to press out various shapes of 3D models with simple foot movements while walking or playing in the snow, increasing the fun and interactivity of snow activities.
2. The present invention makes it easy to connect the shoelace by setting backstop lugs, first lacing holes, front vertical lugs and second lacing holes. Then the shoelace is tied to the consumer's ankle and shoe surface, which is easy to put on when playing snow and easy to take off when not playing.
3. By setting the ink inlet, color ink storage chamber and the bear's eye connection through-hole, the present invention makes it easy to discharge environmentally friendly color ink from the bear's eye 3D printing slot, penguin's eye 3D printing slot or piggy's eye 3D printing slot, so as to make the printed 3D three-dimensional model more vivid, alive and more interesting.
4. By setting the touch surface and friction groove, the present invention can play a better anti-slip role when consumers wear the product walking, to avoid consumers slipping.

Figure 1:
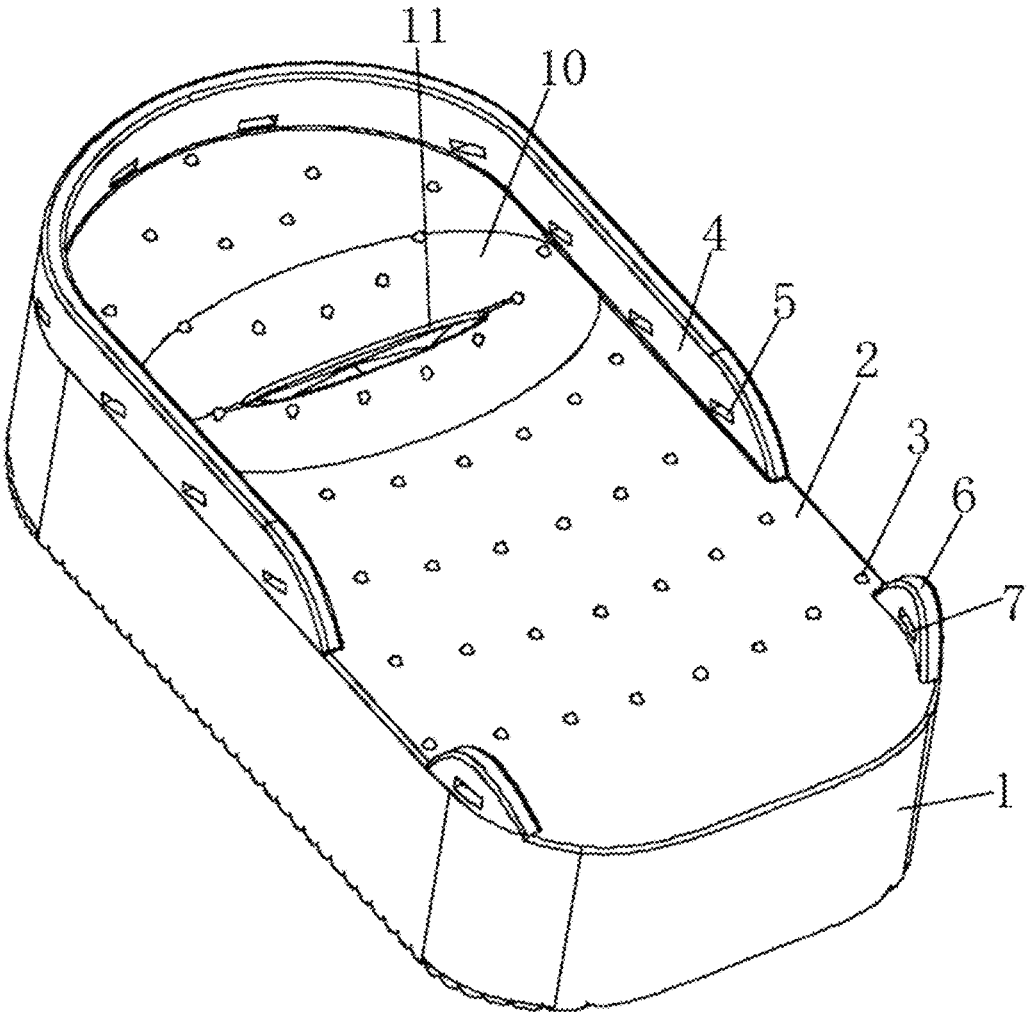
FIG. 1 is a perspective structural diagram of the invention.

In the figures: 1. toy shoe sole main body; 2. shoe treading surface; 3. friction bead; 4. backstop lugs; 5. first lacing holes; 6. front vertical lugs; 7. second lacing holes; 8. touch surface; 9. friction groove; 10. infiltration slope; 11. ink inlet; 12. bear 3D stereoscopic printing groove; 13. bear eye 3D printing groove; 14. bear eye connecting through hole; 15. color ink storage chamber; 16. penguin 3D stereoscopic printing slot; 17. penguin eye 3D printing slot; 18. penguin eye connection through-hole; 19. piglet 3D stereoscopic printing slot; 20. piglet eye 3D printing slot; 21. piglet eye connection through-hole.

DETAILED DESCRIPTION OF THE EMBODIMENTS

The invention will be described in detail below with reference to the accompanying drawings and in conjunction with example embodiments. The various examples are provided by way of explanation of the present invention and are not intended to limit the invention. Indeed, it will be clear to those skilled in the field that modifications and variations may be made in the present invention without departing from the scope or spirit of the invention. For example, features shown or described as part of one embodiment may be used in another embodiment to produce yet another embodiment. Thus, it is expected that the present invention encompasses such modifications and variations as are categorized within the scope of the appended claims and their equivalents.

In the description of the invention, terms such as "longitudinal," "lateral," "up," "down," "front," "back," "left," "right," "vertical," "horizontal," "top," "bottom," etc., are used to indicate orientation or positional relationships based on the orientation or position as shown in the accompanying drawings. These terms are used for the purpose of describing the invention and should not be construed as limiting the invention to specific constructions or operations in a particular orientation. The terms "connected," "coupled," and "provided" should be broadly understood, for example, as fixed connections or detachable connections; direct connections or indirect connections through intermediate components; wired electrical connections, wireless connections, or wireless communication signal connections. The ordinary technician in the field can understand the specific meanings of these terms based on the specific circumstances.

The accompanying drawings illustrate one or more embodiments of the invention. The detailed description uses numerical and alphabetical references to refer to features in the drawings. Similar or like references in the drawings and description are used to refer to similar or like parts of the invention. As used herein, the terms "first," "second," and "third," etc., are used interchangeably to distinguish one component from another and do not intend to indicate the position or importance of individual components.

Example 1

Figure 2:
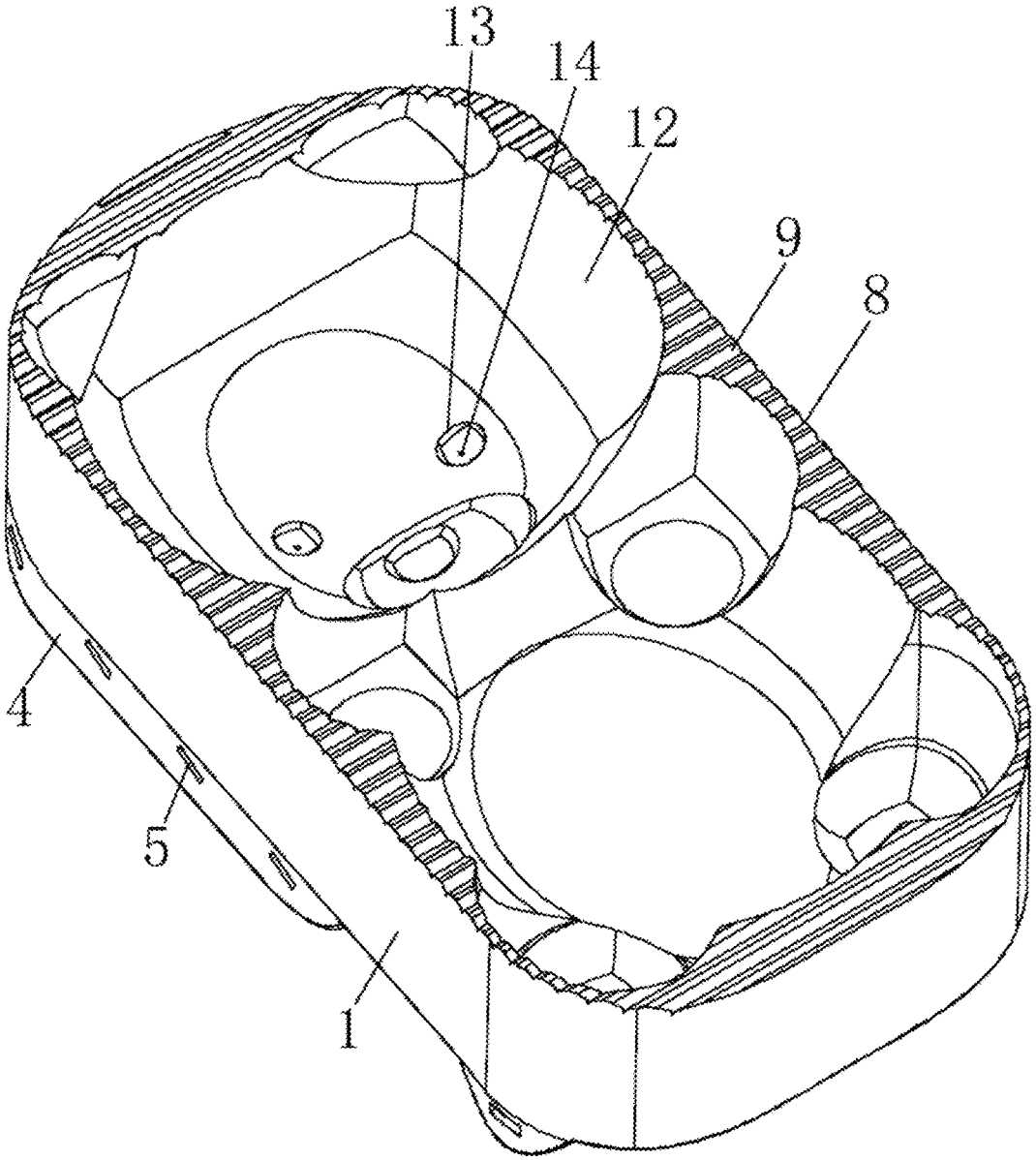
FIG. 2 is a bottom surface structural diagram of the invention.
Figure 3:
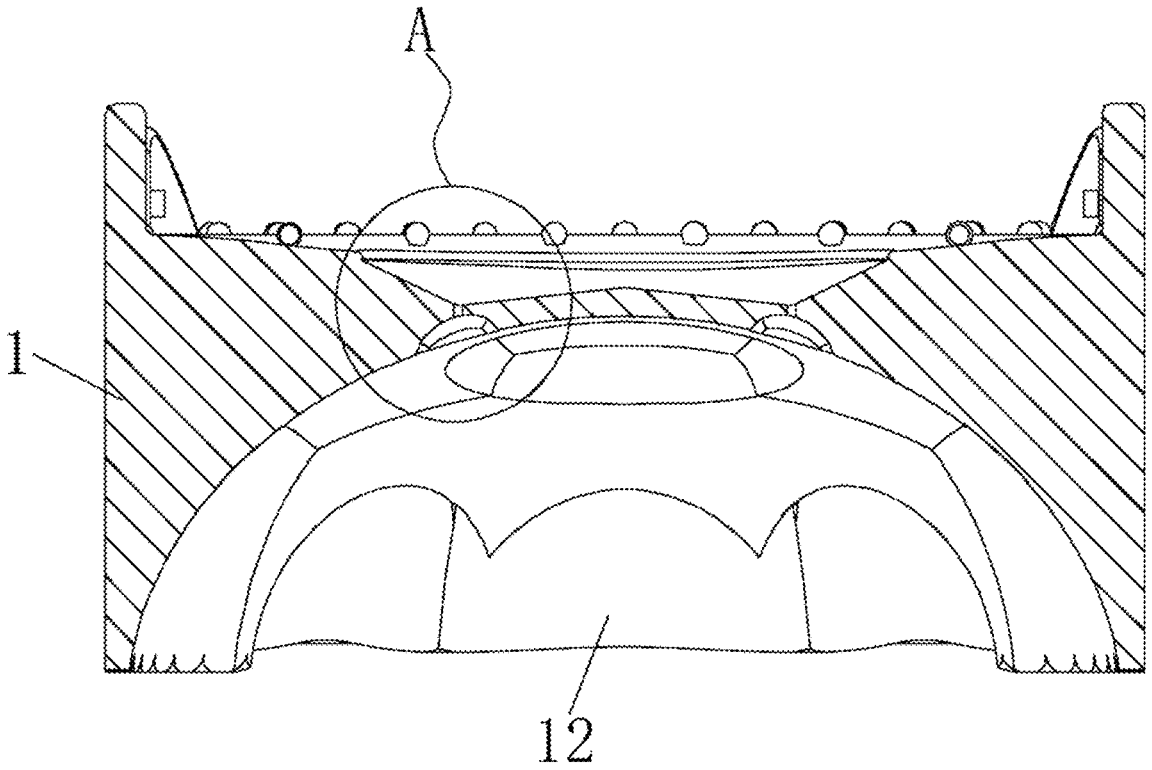
FIG. 3 is a cross-sectional structural diagram of the invention.
Figure 4:
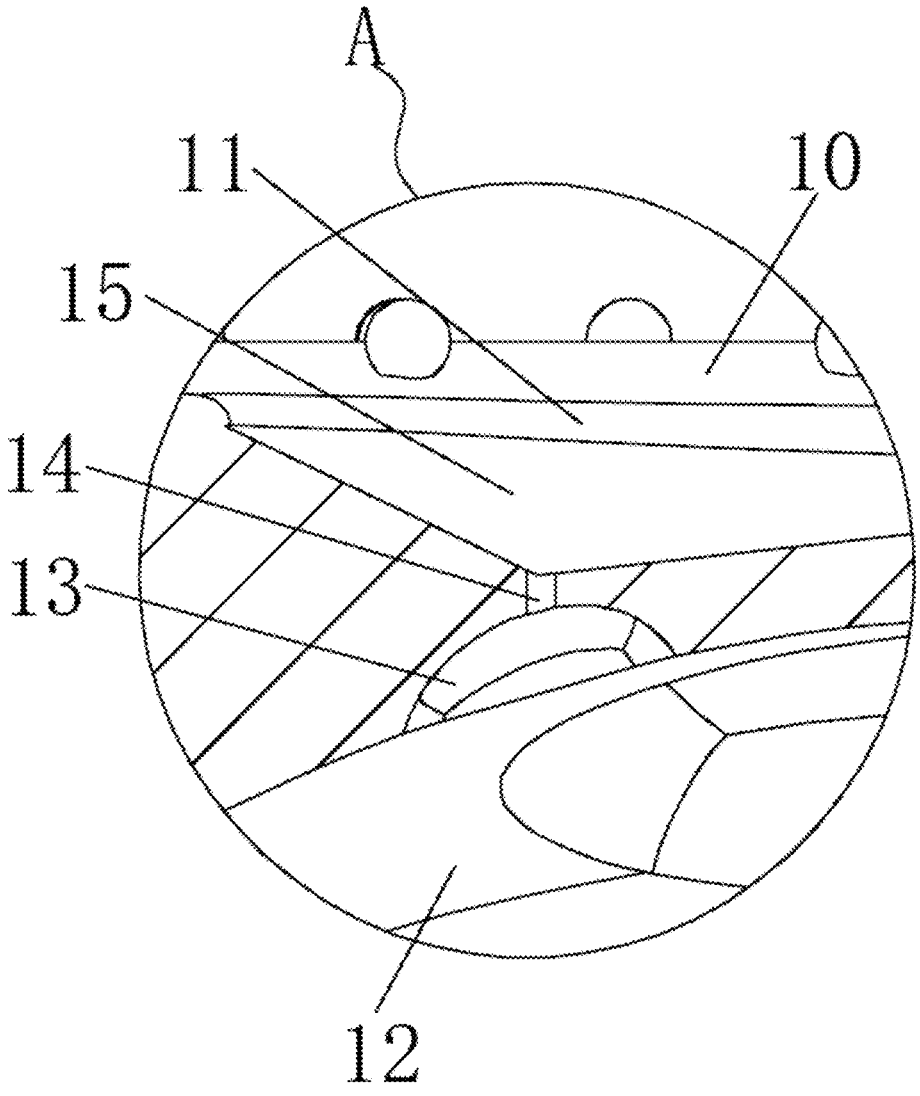
FIG. 4 is an enlarged view of point A in FIG. 3.

Referring to FIGS. 1-4, a 3D model-pressing shoe sole includes a toy shoe sole main body 1 made of PVC material. The toy shoe sole main body 1 is integrally formed from PVC material, which is easy to process and shape, and has strong deformation capabilities. The use of PVC material enhances the comfort when consumers step on the upper surface and improves adaptability to various road surfaces on the bottom.

The upper surface of the toy shoe sole main body 1 is equipped with a shoe treading surface 2, which is designed to be stepped on by the consumer's own shoe sole. Made of PVC material, it is also easy to clean when the product is no longer in use.

Inside the shoe treading surface 2, there is a deflector slope 10, which is an inclined surface that facilitates the flow of colored ink, making it easier to flow towards the central part. The shoe treading surface 2 has an ink inlet 11 located at the center of the deflector slope 10. Inside the toy shoe sole main body 1, there is a color ink storage chamber 15. The ink inlet 11 is designed to channel the colored ink downward into the color ink storage chamber 15 below the inlet. The color ink storage chamber 15 is funnel-shaped for temporary storage of the colored ink. The colored ink used should be eco-friendly, which is produced using environmentally friendly raw materials and meets environmental protection standards. It does not contain harmful substances such as heavy metals, volatile organic compounds (VOCs), and is harmless to the environment and human health.

The bottom surface of the toy shoe sole main body 1 is equipped with a touch surface 8, which has a set of friction grooves 9 on its outer surface. The friction grooves 9 are evenly spaced on the bottom surface of the touch surface 8 and serve to provide good anti-slip properties. On slippery snowy days, they help prevent consumers from slipping and falling. A set of friction beads 3 is integrally formed on the upper surface of the shoe treading surface 2, arranged at equal distances. These friction beads 3 increase the friction between the consumer's shoe sole and the shoe treading surface 2, preventing the product from slipping off when the consumer moves while wearing the product.

The upper surface of the shoe treading surface 2 is integrally formed with a backstop lug 4, which has a set of first lacing holes 5 on the inside. The first lacing holes 5 allow shoelaces to be passed through and then tied around the consumer's ankle to fix the rear part of the product.

There are two front vertical lugs 6 integrally formed on the upper surface of the shoe treading surface 2, each with a second lacing hole 7 on the inside. By passing shoelaces through the two second lacing holes 7, the shoelaces can be tied to the shoe surface that the consumer is already wearing, ultimately achieving a complete fixation of the product.

The touch surface 8 has an animal 3D printing slot on the inside, which is a bear 3D printing slot 12. When consumers wear this product and step on the snow, they can press out a 3D model of a snowman identical to the bear 3D printing slot 12.

The bear 3D printing slot 12 has two bear eye 3D printing slots 13 on the inside, and each of the two bear eye 3D printing slots 13 has a bear eye connection through-hole 14 on top. The two bear eye connection through-holes 14 are located inside the toy shoe sole main body 1 and are connected to the color ink storage chamber 15. The bear eye connection holes 14 are positioned at specific locations of the bear eye 3D printing slots 13, allowing the eco-friendly colored ink from the color ink storage chamber 15 to be squeezed onto the ground to form the eyes of the snowman, making the entire snowman more vivid and increasing the fun.

Working Principle of This Example:

When consumers go out to play in the snow, they first pour the prepared colored ink onto the deflector slope 10. The colored ink, guided by the deflector slope 10, flows through the ink inlet 11 into the interior of the color ink storage chamber 15. Then, shoelaces are passed through each first lacing hole 5, and then tied around the ankles. Next, another shoelace is passed through the two second lacing holes 7 and tied to the consumer's shoe, allowing them to play in the snow. As the consumer steps on the snow, it is compressed into the shape of the bear 3D printing slot 12. The colored ink inside the color ink storage chamber 15 can flow through the bear eye connection holes 14 and land on the bear eye 3D printing slots 13, creating the bear's animal eyes. This adds the finishing touch, providing users with an unprecedented interactive experience and creative fun.

Example 2

Figure 5:
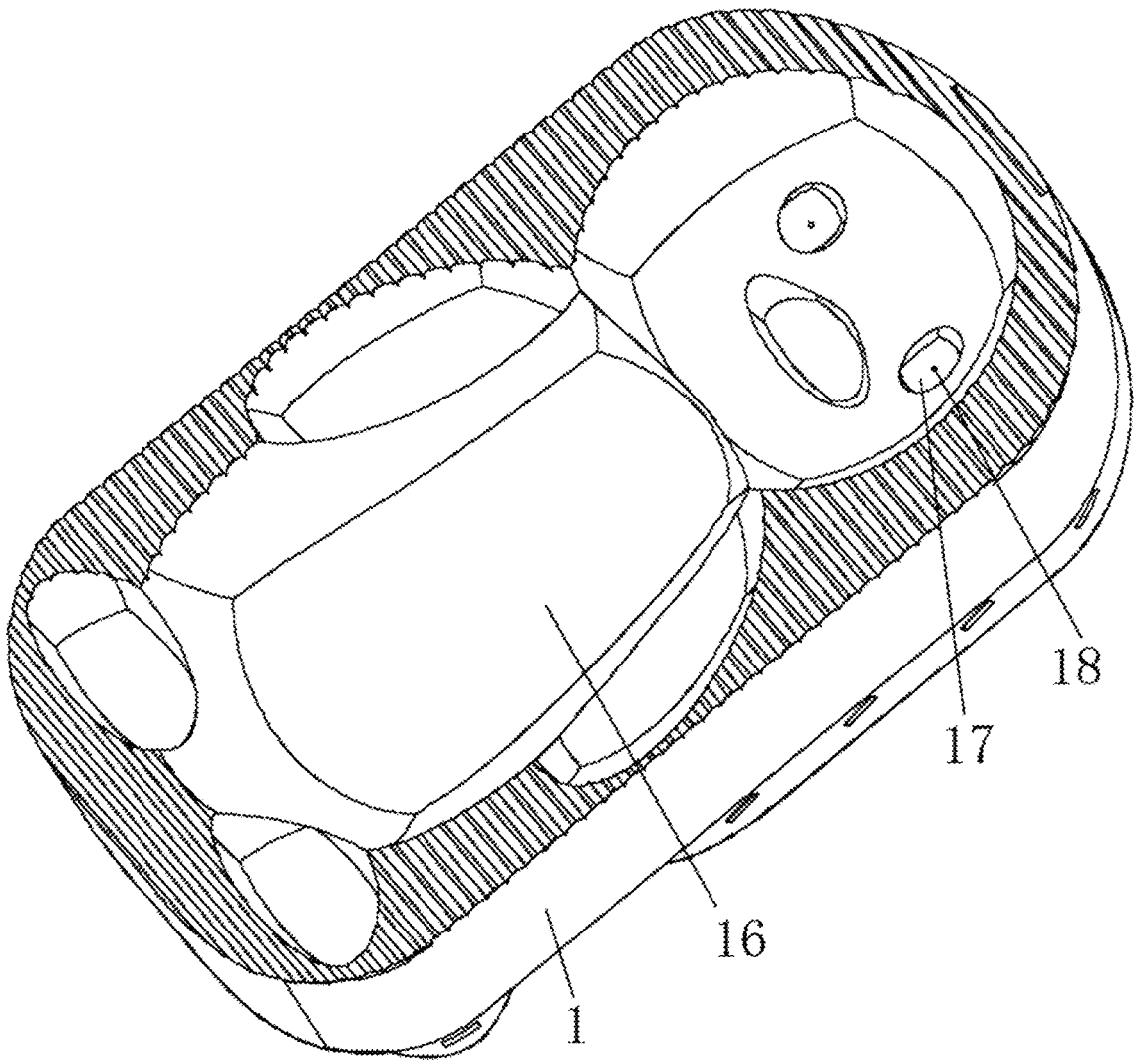
FIG. 5 is a perspective structural diagram of the penguin embodiment of the invention.

This example differs from Example 1 in that it can create a model on the snow with a shape different from the bear 3D printing slot 12, specifically a penguin-shaped 3D printing slot 16. As shown in FIGS. 1, 3, 4, and 5, the animal 3D printing slot is a penguin 3D printing slot 16. Inside the penguin 3D printing slot 16, there are two penguin eye 3D printing slots 17. Above each penguin eye 3D printing slot 17, there is a penguin eye connection hole 18. The two penguin eye connection holes 18 are located inside the toy shoe sole main body 1 and are connected to the color ink storage chamber 15. The penguin eye connection holes 18 are positioned at specific locations of the penguin eye 3D printing slots 17. By setting the penguin eye connection holes 18 according to the positions of the penguin 3D printing slot 16 and the penguin eye 3D printing slots 17, the penguin model printed on the ground can be made more vivid.

Example 3

Figure 6:
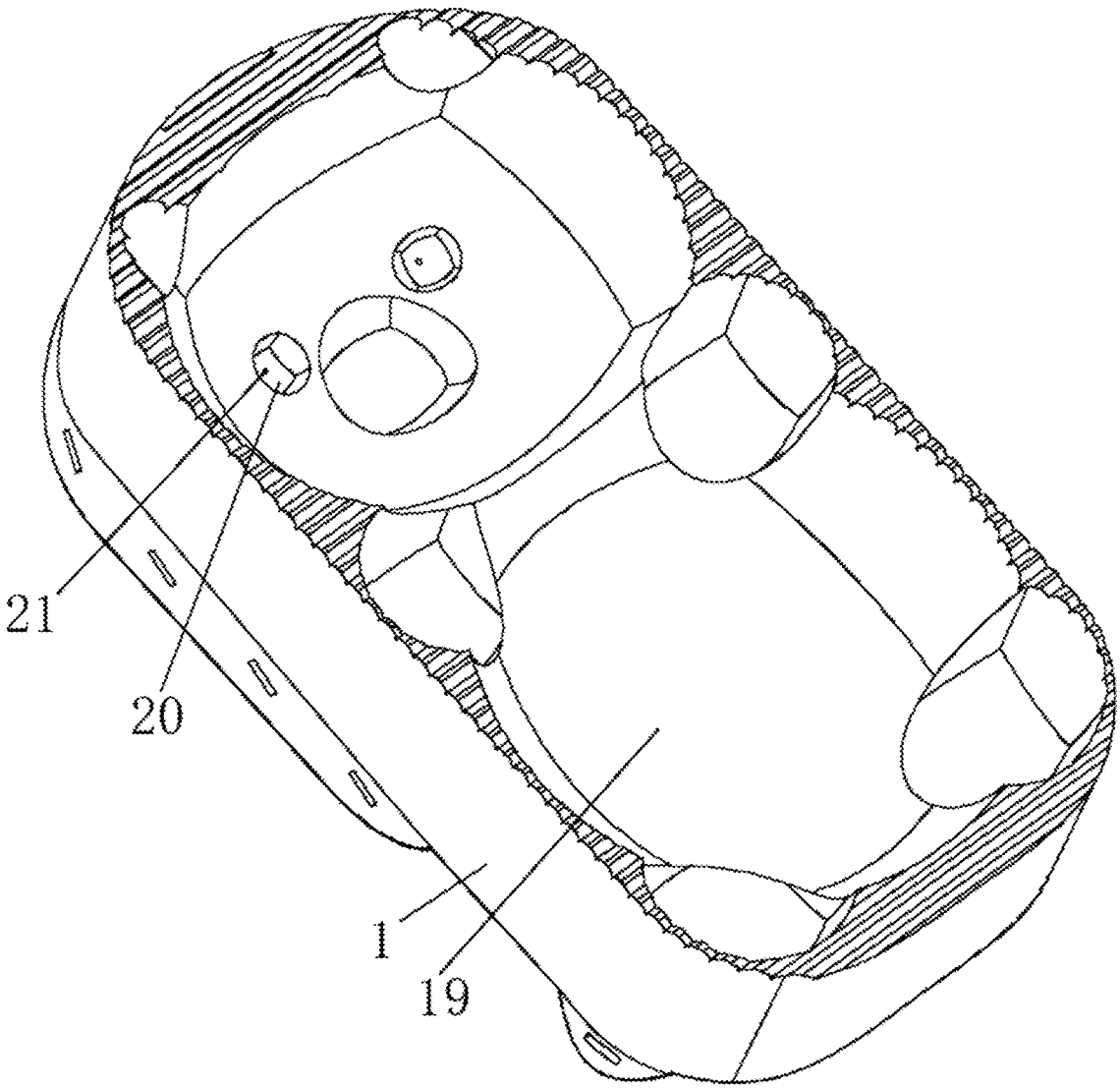
FIG. 6 is a perspective structural diagram of the pig embodiment of the invention.

This example differs from Example 1 in that it can create a model on the snow with a shape different from the bear 3D printing slot 12, specifically a piglet-shaped 3D printing slot 19. As shown in FIGS. 1, 3, 4, and 6, the animal 3D printing slot is a piglet 3D printing slot 19. Inside the piglet 3D printing slot 19, there are two piglet eye 3D printing slots 20. Above each piglet eye 3D printing slot 20, there is a piglet eye connection hole 21. The two piglet eye connection holes 21 are located inside the toy shoe sole main body 1 and are connected to the color ink storage chamber 15. The piglet eye connection holes 21 are positioned at specific locations of the piglet eye 3D printing slots 20. By setting the piglet eye connection holes 21 according to the positions of the piglet 3D printing slot 19 and the piglet eye 3D printing slots 20, the piglet model printed on the ground can be made more vivid.

The above descriptions are merely preferred examples of the invention and are not intended to limit the invention. For those skilled in the field, the invention can be subject to various modifications and variations. Any modifications, equivalent substitutions, improvements, etc., that are made within the spirit and principle of the invention, should be included within the scope of protection of the invention.

The invention claimed is:

1. A 3D model-pressing shoe sole, comprising a toy shoe sole main body (1) made of PVC material, wherein an upper surface of the toy shoe sole main body (1) is equipped with a shoe treading surface (2), wherein an interior of the shoe treading surface (2) is provided with a deflector slope (10), wherein the interior of the shoe treading surface (2) is equipped with an ink inlet (11), wherein the ink inlet (11) is located at a center of the deflector slope (10), wherein the interior of the toy shoe sole main body (1) is equipped with a color ink storage chamber (15), wherein a bottom surface of the toy shoe sole main body (1) is equipped with a touch surface (8), and wherein the interior of the touch surface (8) is equipped with an animal 3D printing slot.

2. The 3D model-pressing shoe sole of claim 1, wherein the upper surface of the shoe treading surface (2) is integrally molded with a set of friction beads (3), and the friction beads (3) are arranged equidistantly on the upper surface of said shoe treading surface (2).

3. The 3D model-pressing shoe sole of claim 1, wherein the upper surface of said shoe treading surface (2) is integrally molded with a backstop lug (4), and a set of first lacing holes (5) are provided in the interior of said backstop lug (4), and wherein the upper surface of the shoe treading surface (2) is integrally molded with two front vertical lugs (6), and a plurality of second lacing holes (7) are provided in the interior of both front vertical lugs (6).

4. The 3D model-pressing shoe sole of claim 1, wherein a set of friction grooves (9) are provided on an outer surface of the touch surface (8), and the friction grooves (9) are provided equidistant from each other on the bottom surface of the touch surface (8).

5. The 3D model-pressing shoe sole of claim 1, wherein the said animal 3D stereo printing groove is a bear 3D stereo printing groove (12).

6. The 3D model-pressing shoe sole of claim 5, wherein two bear eye 3D printing slots (13) are provided in the interior of the bear 3D printing slot (12), wherein multiple bear eye connection through-holes (14) are provided above both the bear eye 3D printing slots (13), and wherein the two bear eye connection through-holes (14) are provided in the interior of the toy sole body (1) and connected to the color ink storage chamber (15).

7. The 3D model-pressing shoe sole of claim 1, wherein the said animal 3D stereo printing slot is a penguin 3D stereo printing slot (16).

8. The 3D model-pressing shoe sole of claim 7, wherein two penguin eye 3D printing slots (17) are provided in the interior of the penguin 3D printing slot (16), wherein two penguin eye connecting through holes (18) are provided above both the penguin eye 3D printing slots (17), and wherein the two penguin eye connection through-holes (18) are provided in the interior of the toy sole body (1) and are connected to the color ink storage chamber (15).

9. The 3D model-pressing shoe sole of claim 1, wherein the animal 3D stereo printing slot is a piglet 3D stereo printing slot (19).

10. The 3D model-pressing shoe sole of claim 9, wherein two piglet eye 3D printing slots (20) are provided in the interior of the piglet 3D printing slot (19), wherein two piglet eye connecting holes (21) are provided above both the piglet eye 3D printing slots (20), and wherein the two piggy eye connection through-holes (21) are provided in the interior of the toy sole body (1) and are connected to the color ink storage chamber (15).

* * * * *